United States Patent [19]

Carruba

[11] Patent Number: 4,842,446

[45] **Date of Patent: * Jun. 27, 1989**

[54] OFFSHORE SUPPORT STRUCTURE METHODS AND APPARATUS

[75] Inventor: Samuel C. Carruba, Fulshear, Tex.

[73] Assignee: CBS Engineering, Inc., Houston, Tex.

[ * ] Notice: The portion of the term of this patent subsequent to Apr. 4, 2006 has been disclaimed.

[21] Appl. No.: 57,035

[22] Filed: May 29, 1987

Related U.S. Application Data

[63] Continuation-in-part of Ser. No. 908,408, Sep. 16, 1986.

[51] Int. Cl.[4] ..... E02B 17/00

[52] U.S. Cl. ..... 405/227; 166/367; 405/195

[58] Field of Search ..... 405/195, 202, 203, 204, 405/227, 224; 166/335, 367

[56] References Cited

U.S. PATENT DOCUMENTS

| | | | |
|---|---|---|---|
| 2,927,435 | 3/1960 | Upson | 405/227 |
| 3,306,052 | 2/1967 | Kawasaki | 405/205 |
| 3,516,259 | 6/1970 | Tokola | 405/208 |
| 3,852,969 | 12/1974 | Gibson et al. | 405/204 |
| 4,000,624 | 1/1977 | Chow | 405/204 |
| 4,558,973 | 12/1985 | Blandford | 405/216 |

OTHER PUBLICATIONS

Blue Print No. 101 of Dec. 1985, entitled Jacket Elevations.

*Primary Examiner*—David H. Corbin
*Attorney, Agent, or Firm*—Ben D. Tobor

[57] ABSTRACT

Methods and apparatus for supporting vertical members in an offshore environment, utilize support members which are either clamped to the vertical member by use of a pipe clamp, or are clamped to the vertical member via a pipe clamp which is pivotably connected to the support leg.

9 Claims, 13 Drawing Sheets

OFFSHORE SUPPORT STRUCTURE METHODS AND APPARATUS

RELATED APPLICATIONS

This application is a continuation-in-part of U.S. patent application Ser. No. 06/908,408, filed Sept. 16, 1986, entitled "Offshore Support Structure Methods and Apparatus".

FIELD OF THE INVENTION

The invention relates to offshore support structure methods and apparatus for use with wells located in a body of water, the wells having an upstanding conductor pipe extending from the ground below the body of water to above the surface of the water.

DESCRIPTION OF THE PRIOR ART

Typically in wells completed at offshore locations, the well has been drilled from a jackup drilling rig or a semi-submersible drilling rig, and the vessel which supports the drilling rig typically remains on location during the drilling process. When the drilling vessel is subsequently moved to another location, the well is typically left with suitable casing in the borehole extending to some selected depth and production tubing is also typically installed. A conductor pipe typically surrounds the casing and extends into the ground below the body of water and it typically extends upwardly beyond the surface of the water a distance of between 15 and 45 feet, or perhaps higher. The conductor pipe may have a diameter from 30 to 100 inches. The water depth may be from 40–50 feet to 200–250 feet deep, which are considered relatively shallow offshore depths.

The well is typically shut in by installing suitable closed valves or plugs in the well, and the conductor pipe is thus left unsupported, extending from the ground beneath the body of water to above the surface of the water. In order to produce hydrocarbons from the well, it is necessary that some type of platform structure, such as a production platform, be installed above the well in order that the hydrocarbons from the well can be produced. As is conventional in the art, well production equipment is typically installed upon the production platform at the well. In some instances, the production platform is fabricated on an integral unit on shore and then towed to the location of the well and installed. Such integral production platforms are not fabricated quickly and they must be designed and fabricated to exactly conform to the particular water depth and soil conditions and elevations present at the site of the offshore well. Accordingly, the exposed and unsupported conductor pipe can be unprotected and unsupported for a period of time which can be from twelve to eighteen months until after the completion of the well, at which time the totally fabricated production platform is ready for installation at the offshore well. During that period of time the free-standing conductor pipe is vulnerable to damage from navigating ships in the area, and it can also be damaged by forces exerted by the body of water caused by severe weather conditions such as winter storms and/or summer hurricanes. It is thus susceptible to bending and damage when left unprotected. Accordingly, it would be desirable to economically and efficiently support the conductor pipe to protect it until such time as a production platform structure can be permanently installed.

In view of the high cost of the typical permanent production platform, which is typically fabricated as an integral unit and installed at the offshore well, it would be desirable if a support structure for supporting the conductor pipe could also be utilized to either assist in supporting a platform structure, or to provide enough support to the conductor pipe, so that the conductor pipe could support a platform structure disposed upon the conductor pipe. Such double duty by the support structure would greatly reduce the costs associated with the production platform. By reducing the costs of placing the well into production, it is thus possible that some less productive, or marginal, offshore wells could be placed into production of hydrocarbons.

Such a support structure for the conductor pipes of offshore wells has been previously proposed and utilized as disclosed in U.S. Pat. No. 4,558,973. However, it is believed that such a support structure has presented some problems. This prior art support structure utilizes a clamp structure to secure the support structure to the conductor pipe and the clamp structure extends from the ground below the body of water upwardly over and along a substantial portion of the length of the conductor pipe disposed under the surface of the water. This clamp structure utilizes a plurality of bolts extending along its length, which bolts must be tightened by divers at the time of installation of the support structure. Further, at least four piles must be driven to secure the support structure to the ground below the body of water. Thus, an extensive amount of time and energy is required in installing such a support structure, particularly with respect to the great number of bolts which must be secured. Such bolts require the services of an underwater diver to complete the bolt fastening step, as well as the time and effort necessary to drive the four piles.

Accordingly, prior to the development of the present invention, there have been no offshore support structure methods and apparatus for use with conductor pipes of offshore wells which: are simple and economical to manufacture and use; are easily assembled; require a minimum amount of work to be performed by underwater divers; and require a minimum number of piles to be driven into the ground beneath the body of water.

Therefore, the art has sought offshore support structure methods and apparatus for use with conductor pipes of offshore wells which: are simple and economical to manufacture and use; are easily assembled; require a minimum amount of work by underwater divers; and require a minimum number of piles to be driven into the ground beneath the body of water.

SUMMARY OF THE INVENTION

In accordance with the invention, the foregoing advantages have been achieved through the present support structure for use with an offshore well located in a body of water, the well having an upstanding conductor pipe, having upper and lower ends, extending from the ground below the body of water to above the surface of the water. The present invention includes: two tubular legs, each leg having upper and lower ends, the upper end of each leg adapted to extend beyond the surface of the water and the lower end of each leg adapted to be disposed upon the ground; a first set of bracing members disposed between and interconnecting the legs in a spaced relationship from one another; first and second conductor pipe clamps, the first conductor pipe clamp adapted to be disposed about the upper end of the conductor pipe, and the second conductor pipe clamp adapted to be disposed about the lower end of the conductor pipe; a second set of bracing members, each bracing member of the set having first and second ends, the first ends of each bracing member being connected to one of the legs, the second ends of each bracing member being secured to the first conductor pipe clamp, the second set of bracing members extending outwardly and away from each of the legs; and a third set of bracing members, each bracing member of the set having first and second ends, the first ends of each bracing member being connected to one of the legs, the second ends of each bracing member being secured to the second conductor pipe clamp, the third set of bracing members extending outwardly and away from each of the legs, whereby upon the first and second conductor pipe clamps being secured to the upper and lower ends of the conductor pipe, the conductor pipe will be supported by the legs and the second and third sets of bracing members.

Another feature of the present invention is that a platform structure may be disposed upon and supported by the conductor pipe, or a platform structure may be disposed upon and supported by the conductor pipe and the two legs.

In accordance with another aspect of the invention, the foregoing advantages have been achieved through the present support structure for use with a well located in a body of water, the well having an upstanding conductor pipe, having upper and lower ends extending from the ground below the body of water to above the surface of the water. This aspect of the present invention includes: two tubular legs, each leg having upper and lower ends and adapted to extend from the ground to at least the surface of the water; a pile skirt pivotably disposed at the lower end of each of the two legs; and means for pivotably connecting the upper ends of each of the two legs to the conductor pipe, the two legs being radially spaced from one another; the pivotal connection means being adapted to be disposed upon the conductor pipe at least at the surface of the water or higher, whereby the two legs and pivotal connection means can be secured at their upper ends to the conductor pipe and the lower ends of the legs can be pivoted downwardly into contact with the ground. A further feature of the present invention is that a platform structure may be disposed upon the conductor pipe.

The present invention also includes a method for supporting an upstanding conductor pipe of a well located in a body of water, the conductor pipe having upper and lower ends and extends from the ground below the body of water to above the surface of the water. This aspect of the present invention includes the steps of: floating in the water two legs, each leg having upper and lower ends, and a pile skirt pivotably disposed at the lower end of each leg; disposing the upper ends of each leg adjacent the portion of the conductor pipe extending above the surface of the water; pivotably connecting the upper ends of each of the two legs to the conductor pipe at the surface of the water or at a locaton upon the conductor pipe higher than the surface of the water; pivoting each of the legs downwardly until the pile skirt of each leg contacts the ground; and driving a single pile through each pile skirt to fixedly secure each leg to the ground, whereby the conductor pipe is supported toward its upper end within the body of water. Another feature the present invention is the step of disposing a platform structure upon the conductor pipe, the platform structure being fixedly secured to only the conductor pipe.

In accordance with the invention, the foregoing advantages have also been achieved through a support structure for use with a well located in a body of water, the well having an upstanding conductor pipe, having upper and lower ends, extending from the ground below the body of water to above the surface of the water. The present invention includes at least one elongate support member having upper and lower ends; means for connecting the support member to the conductor pipe, the connection means being disposed at the upper and lower ends of the support members; means for pivotably connecting the upper end of the support member with respect to the lower end of the support member, the pivotal connection means being disposed between the upper and lower ends of the support member, whereby the lower end of the support member may be connected to the conductor pipe and the upper end of the support member may be pivoted until the upper end of the support member is connected to the conductor pipe toward the upper end of the conductor pipe.

Another feature of the present invention is that the connection means may comprise pipe clamps associated with the upper and lower ends of the support member, and the pipe clamps may be pivotably connected by the upper and lower ends of the support member by pivot pin joints. A further feature of the present invention is that a platform structure may be disposed upon the conductor pipe.

In accordance with the invention, the foregoing advantages have also been achieved through the present method for supporting an upstanding conductor pipe of a well located in a body of water, the conductor pipe having upper and lower ends and extends from the ground below the body of water to above the surface of the water. The present invention includes the steps of: disposing at least one elongate support member adjacent the upper end of the conductor pipe at the surface of the water, the support member having upper and lower ends, means for connecting the support member to the conductor pipe disposed at the upper and lower ends of the support member and means for pivotably connecting the upper end of the support member with respect to the lower end of the support member; connecting the lower end of at least one support member to the conductor member; lowering the lower end of the at least one support member and pivoting the upper end of the support member with respect to the lower end of the support member, the upper end of the support member being pivoted upwardly toward the conductor pipe; connecting the upper end of the at least one support member to the conductor pipe; and fixedly securing the upper and lower ends of the support member to the conductor pipe, whereby the at least one support member supports the conductor pipe against forces exerted upon it by the body of water.

A further feature of the present invention is that the lower end of the support member may be connected to the conductor pipe by clamping a pipe clamp about the conductor pipe, the pipe clamp being associated with the lower end of the support member, and the pipe clamp may be pivotably connected to the lower end of the support member. Another further feature of the present invention is the step of disposing a platform structure upon the conductor pipe.

In accordance with the invention, the foregoing advantages have also been achieved through a support structure for use with a well located in a body of water, the well having an upstanding conductor pipe, having upper and lower ends, extending from the ground below the water to above the surface of the water. The present invention includes two tubular legs, each leg having upper and lower ends, the upper end of each leg adapted to extend beyond the surface of the water and the lower end of each leg adapted to be disposed upon the ground; a first set of bracing members disposed between and interconnecting the legs in a spaced relationship from one another; first and second conductor pipe clamps, the first conductor pipe clamp adapted to be disposed about the upper end of the conductor pipe, and the second conductor pipe clamp adapted to be disposed about the conductor pipe intermediate the upper and lower ends of the conductor pipe; a second set of bracing members, each bracing member of the set having first and second ends, the first ends of each bracing member being connected to one of the legs, the second ends of each bracing member being secured to the first conductor pipe clamp, the second set of bracing members extending outwardly and away from each of the legs; and a third set of bracing members, each bracing member of the set having first and second ends, the first ends of each bracing member being connected to one of the legs, the second ends of each bracing member being secured to the second conductor pipe clamp, the third set of bracing members extending outwardly and away from each of the legs, whereby upon the first and second conductor pipe clamps being secured to upper and lower ends of the conductor pipe, the conductor pipe will be supported by the legs and the second and third sets of bracing members.

A further feature of the present invention is that the support structure may include a fourth set of bracing members, each bracing member of the fourth set being associated with, and disposed between the first and second conductor pipe clamps, each bracing member of the fourth set being disposed substantially parallel with the conductor pipe.

The offshore support structure methods and apparatus for use with a well having an upstanding conductor pipe of the present invention, when compared with previously proposed prior art offshore support structure methods and apparatus, have the advantages of: being simple and economical to manufacture and use; are easily assembled; require a minimum amount of time and effort being spent by underwater divers; and require a minimum number of piles to be driven into the ground beneath the body of water.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 2:
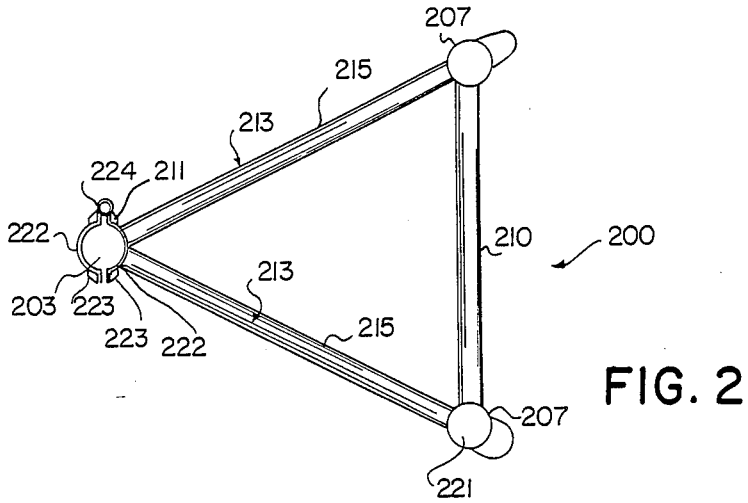
FIG. 2 is a top view of the support structure of FIG. 1.
Figure 1:
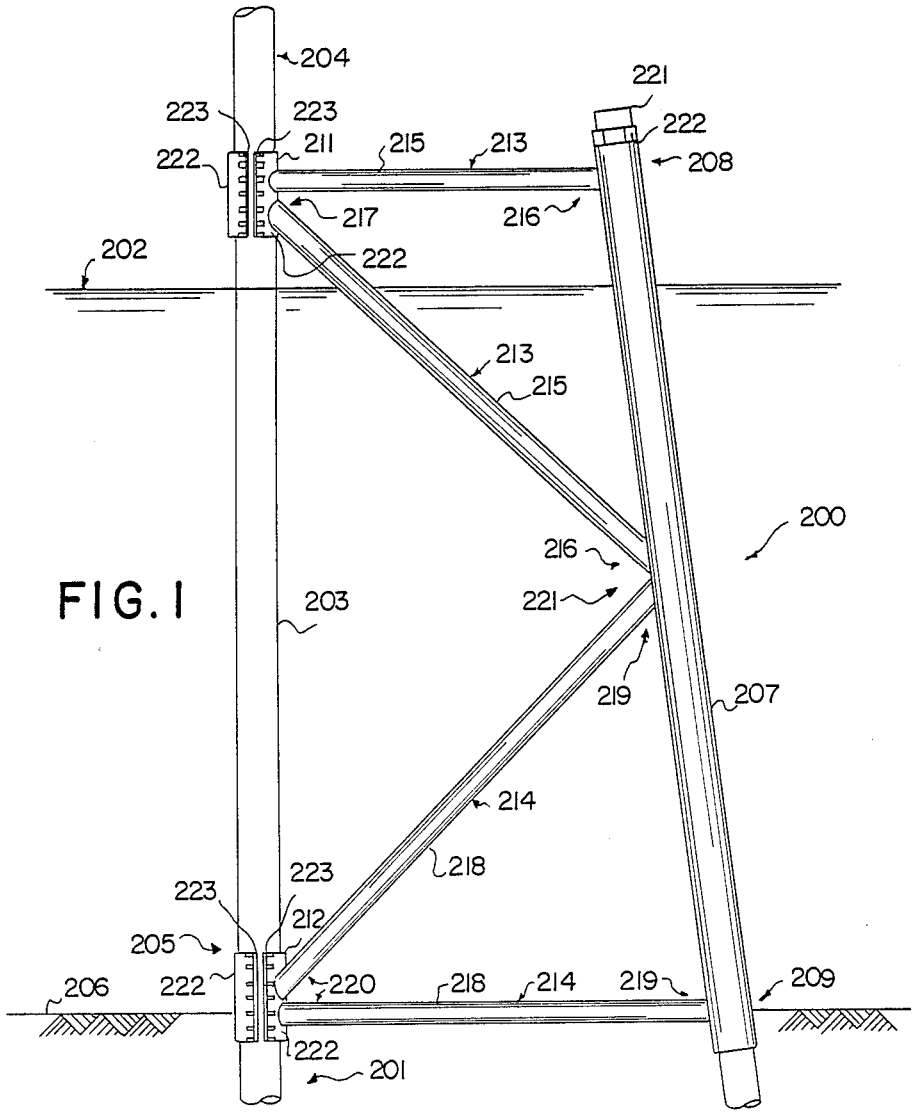
FIG. 1 is a side view of a support structure in accordance with the present invention.
Figure 3:
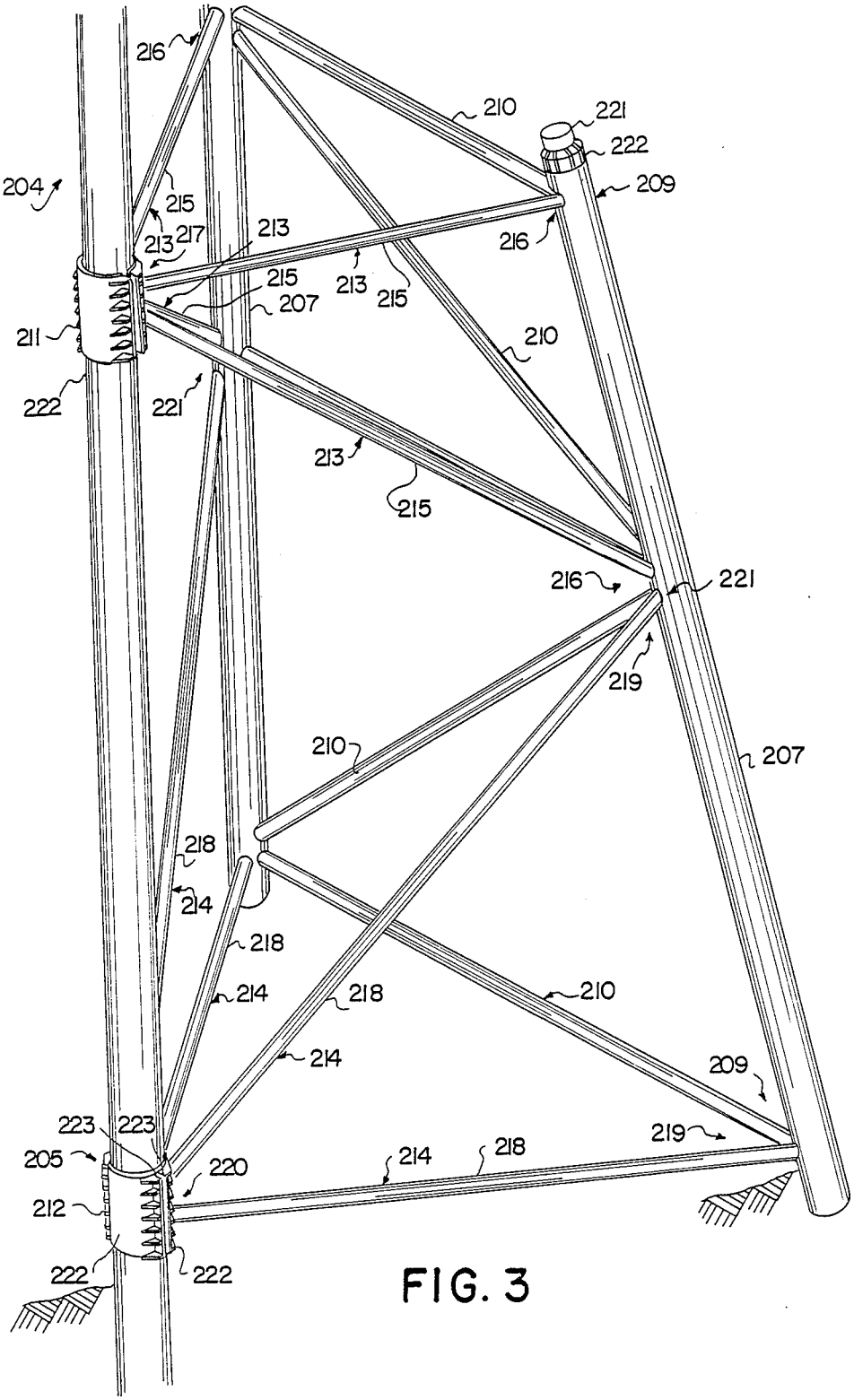
FIG. 3 is a perspective view of the support structure of FIG. 1.

With reference to FIGS. 1-3, a support structure 200 in accordance with the present invention is shown in use with a well 201 located in a body of water 202, the well 201 having an upstanding conductor pipe 203, having upper and lower ends 204, 205, extending from the ground 206 below the body of water 202 to above the surface of the water 202. Support structure 200 generally comprises two tubular legs 207, each leg having upper and lower ends 208, 209; a first set of bracing members 210 disposed between and interconnecting legs 207 in a spaced relationship from one another; first and second conductor pipe clamps 211, 212; a second set of bracing members 213; and a third set of bracing members 214.

Still with reference to FIGS. 1-3, it is seen that each of the tubular legs 207 has their upper ends 208 extending beyond the surface of the water 202, and the lower end 209 of each leg 207 is disposed upon ground 206. As seen in FIGS. 1 and 3, the first conductor pipe clamp 211 is disposed about the upper end 204 of conductor pipe 203, and the second conductor pipe clamp 212 is disposed about the lower end 205 of conductor pipe 203. As seen in FIGS. 1-3, each bracing member 215 of the second set 213 of bracing members has first and second ends 216, 217. The first ends 216 of each bracing member 215 are connected to one of the legs 207. The second ends 217 of each bracing member 215 are secured to the first conductor pipe clamp 211, and each of the bracing members 215 of the second set 213 of bracing members extend outwardly and away from each of the legs 207.

Still with reference to FIGS. 1–3, it is seen that each bracing member 218 of the third set 214 of bracing members has first and second ends 219, 220, the first ends 219 of each bracing member 218 are connected to one of the legs 207. The second ends 220 of each bracing member 218 are secured to the second conductor pipe clamp 212, and the third set 214 of bracing members 218 are seen to each extend outwardly and away from each of the legs 207. As will be hereinafter described in greater detail, a conventional pile 221 is disposed within each leg 207, piles 221 having been driven into the ground 206 in a conventional manner. A segmented sleeve, coupling or pile to jacket connection 222 may be utilized to secure the pile 221 to leg 207.

As seen most clearly in FIG. 3, a bracing member 218 of the third set 214 of bracing members is disposed between second conductor pipe clamp 212 and each leg 207, the bracing member 218 extending from a location 221 disposed intermediate the upper and lower ends 208, 209 of each leg 207. Likewise, between the first conductor pipe clamp 211 and the location 221 disposed intermediate the upper and lower ends 208, 209 of each leg 207, there is disposed a bracing member 215 of the second set 213 of bracing members. In turn, a bracing member 218 of the third set 214 of bracing members extends from the lower end 209 of each tubular leg 207 to the second conductor pipe clamp 212, and a bracing member 215 of the second set 213 of bracing members extends from the upper end 208 of each leg 207 to the first conductor pipe clamp 211. Thus, a rigid support structure 200 is provided which has adequate rigidity, or stiffness, to carry lateral loads or forces exerted by the body of water 202 upon support structure 200 and conductor pipe 203.

It should be noted that the components of support structure 200, specifically, legs 207, and the first, second and third sets of bracing members 210, 213, and 214, are constructed of conventional materials utilized for offshore utilization, and are preferably of tubular steel construction. First and second conductor pipe clamps 211, 212 are preferably each formed of two steel plates 222 having a semi-circular cross-sectional configuration. Each plate 222 also have a pair of outwardly extending flanges 223 through which a plurality of bolts (not shown) may be passed through to securely clamp the first and second conductor pipe clamps 211, 212 to conductor pipe 203. Such clamping in turn securely clamps the support legs 207 to conductor pipe 203 via the second and third sets of bracing members 213, 214. Alternatively, plate members 222 could be hinged to one another as at 224 (FIG. 2), whereby each plate member 222 would only have one outwardly extending flange 223, and only one set of bolts (not shown) would need to be passed through the flange members 223 to secure the conductor pipe clamps 211, 212 to conductor pipe 203.

The installation of support structure 200 of FIGS. 1–3 is readily accomplished in the following manner. The support structure 200 is typically taken by a barge to the location of well 201 and conductor pipe 203, whereat support strucure 200 is lifted by a crane until the first and second conductor pipe clamps 211, 212 abut conductor pipe 203. The crane (not shown) is typically disposed upon the barge (not shown) or another vessel. The crane could suspend the support strucure 200 adjacent conductor pipe 203 so that both conductor pipe clamps 211, 212 may be loosely secured by tightening the bolts (not shown) through flange members 223. Alternatively, the second conductor pipe clamp 212 could be secured first while being disposed above the surface of water 202, and then support structure 200 could be lowered until the first conductor pipe clamp 211 can be loosely tightened upon conductor pipe 203. Further, dependent upon the height of pipe 203 which extends above the surface of water 202, either clamp 211 or both clamps 211, 212 could be loosely bolted together, and the clamp or clamps of support structure 200 could be stabbed over the upper end 204 of pipe 203. In any case, after the conductor pipe clamps 211, 212 are loosely secured to conductor pipe 203, support structure 200 is lowered until the lower ends 209 of the tubular legs 207 and the second conductor pipe clamp 212 rest upon the ground 206.

With certain soil conditions support structure 200 is lowered until it assumes the position shown in FIG. 1, wherein the lower ends 209 of legs 207 and the second conductor pipe clamp 212 have sunk slightly into ground 206. Divers are then sent into water 202 in order to tighten the bolts of the second conductor pipe clamp 212. From the surface of water 202, the bolts of the first conductor pipe clamp 211 may be readily fixedly secured. A pile 221 is then driven through each of the legs 207 in a conventional manner to firmly secure support structure 200 to the ground 206. As previously described, a segmented sleeve, coupling, or pile to jacket connection device 222 is then installed to securely affix pile 221 to the leg 207. If a permanent installation of support structure 200 is desired, and/or for further strength, the first conductor pipe clamp 211, as well as the second conductor pipe clamp 212, if desired, could be welded to the conductor pipe 203 in a conventional manner.

Figure 4:
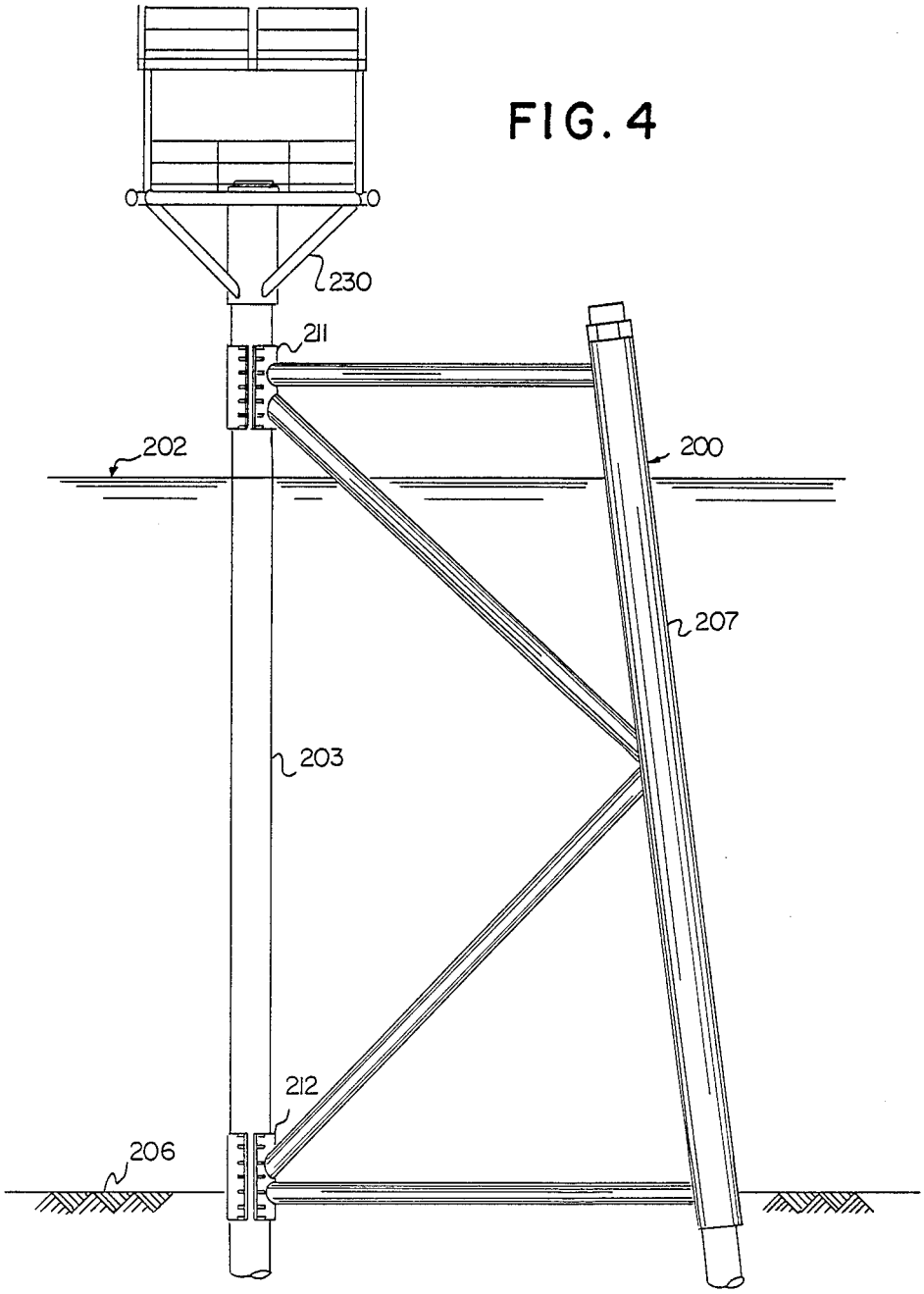
FIG. 4 is a side view of the support structure of FIG. 1, illustrating a platform structure being supported by the conductor pipe.
Figure 5:
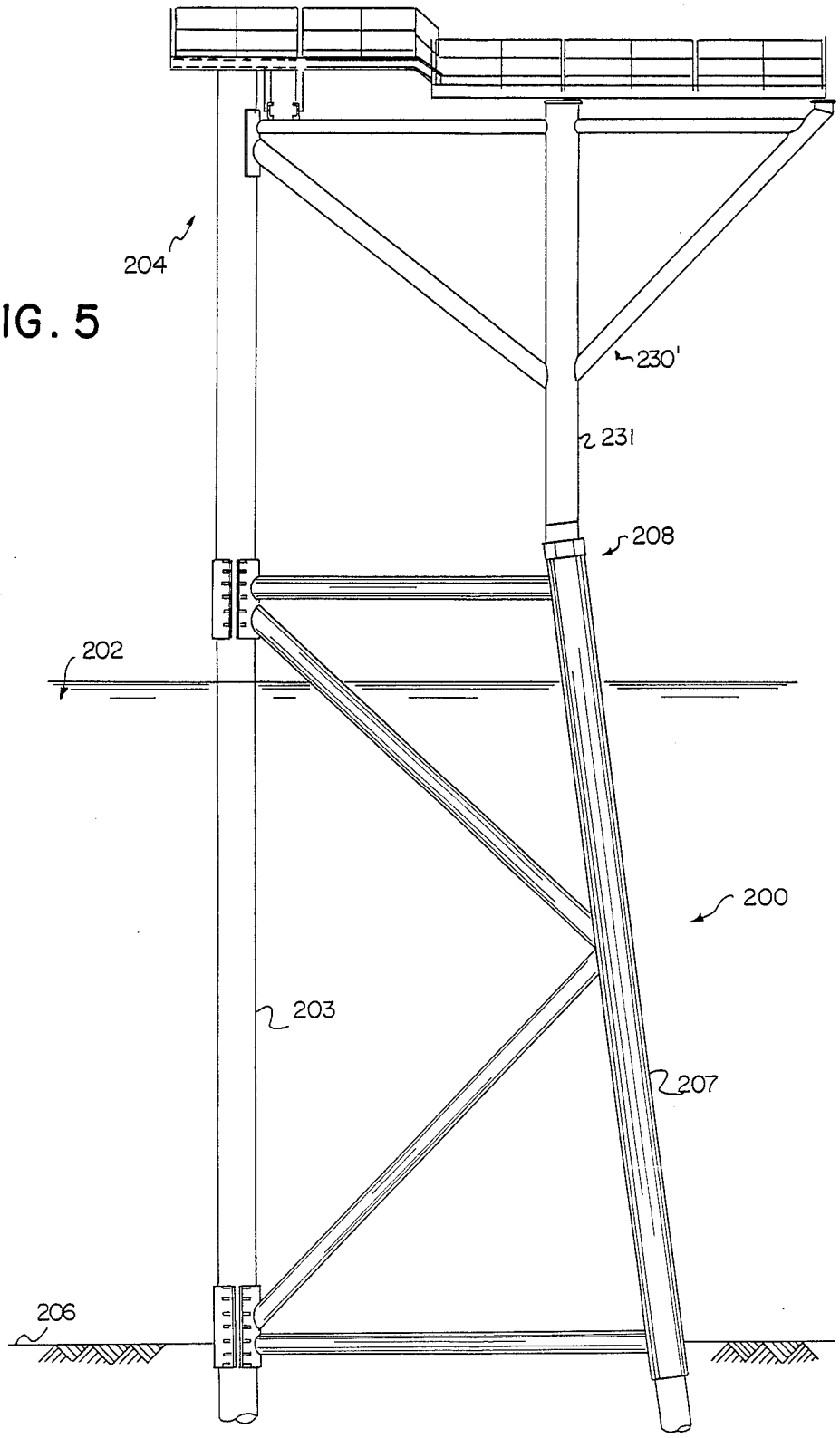
FIG. 5 is a side view of the support structure of FIG. 1, illustrating a platform structure being supported by the conductor pipe and the support structure of FIG. 1.

With reference to FIGS. 4 and 5, it is seen that support structure 200 could be utilized to support conductor pipe 203 whereby a platform structure 230 may be disposed upon and supported solely by conductor pipe 203, as seen in FIG. 4. Alternatively, as seen in FIG. 5, a platform structure 230' could be disposed upon and supported by conductor pipe 203 and the two legs 207 of support structure 200. The platform structure 230 of FIG. 4 could be either a small production or caisson deck which provides means for access to the wellhead, or conductor pipe 203, as seen in FIG. 4.

The platform structure 230' of FIG. 5 is illustrated to be a full production deck as is conventional in the art. A portion of the production deck, or platform structure 230', rests upon the upper end 204 of conductor pipe 203, and two vertical support columns 231 are disposed upon the upper ends 208 of each of the legs 207.

Figure 6:
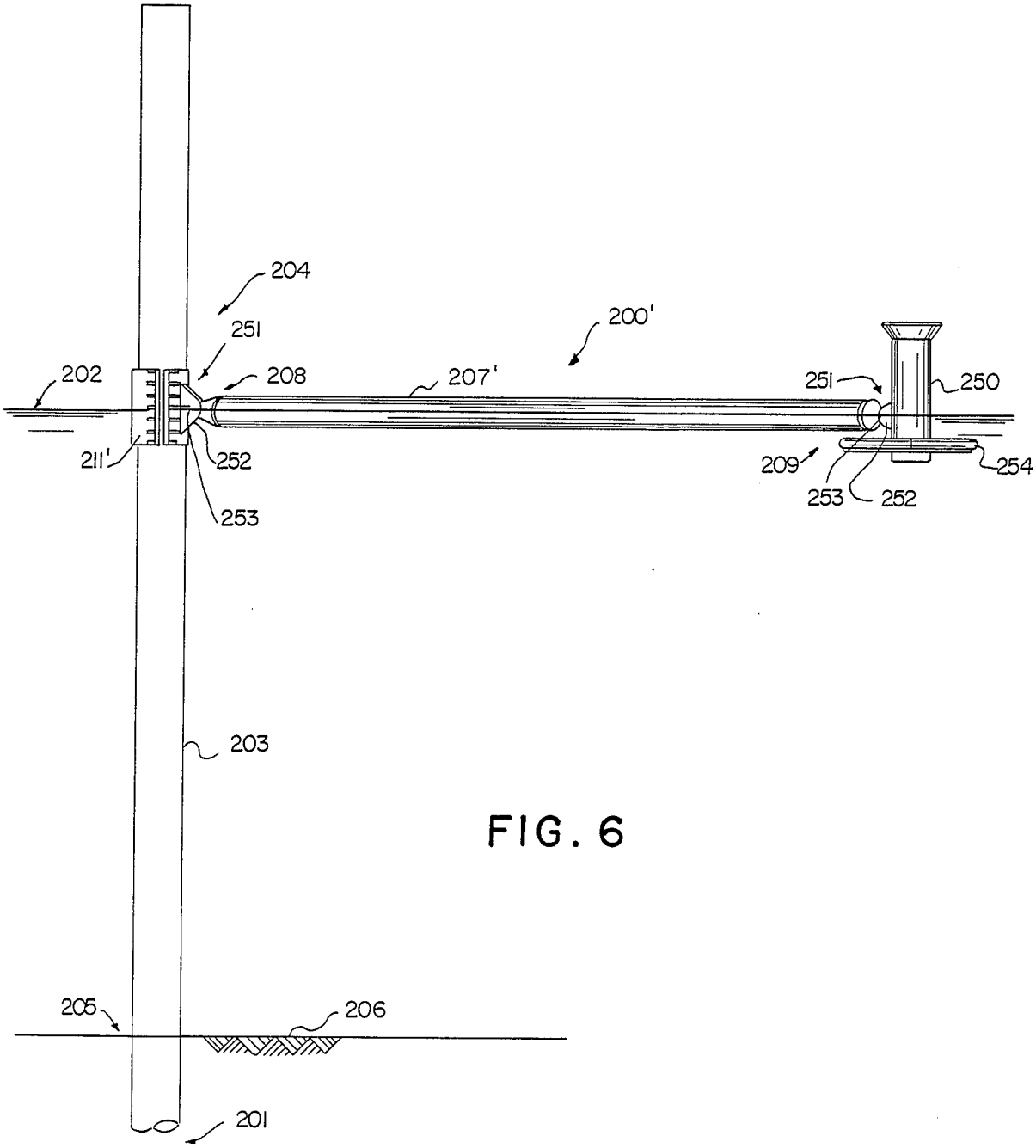
FIG. 6 is a side view of a support structure in accordance with the present invention.
Figure 7:
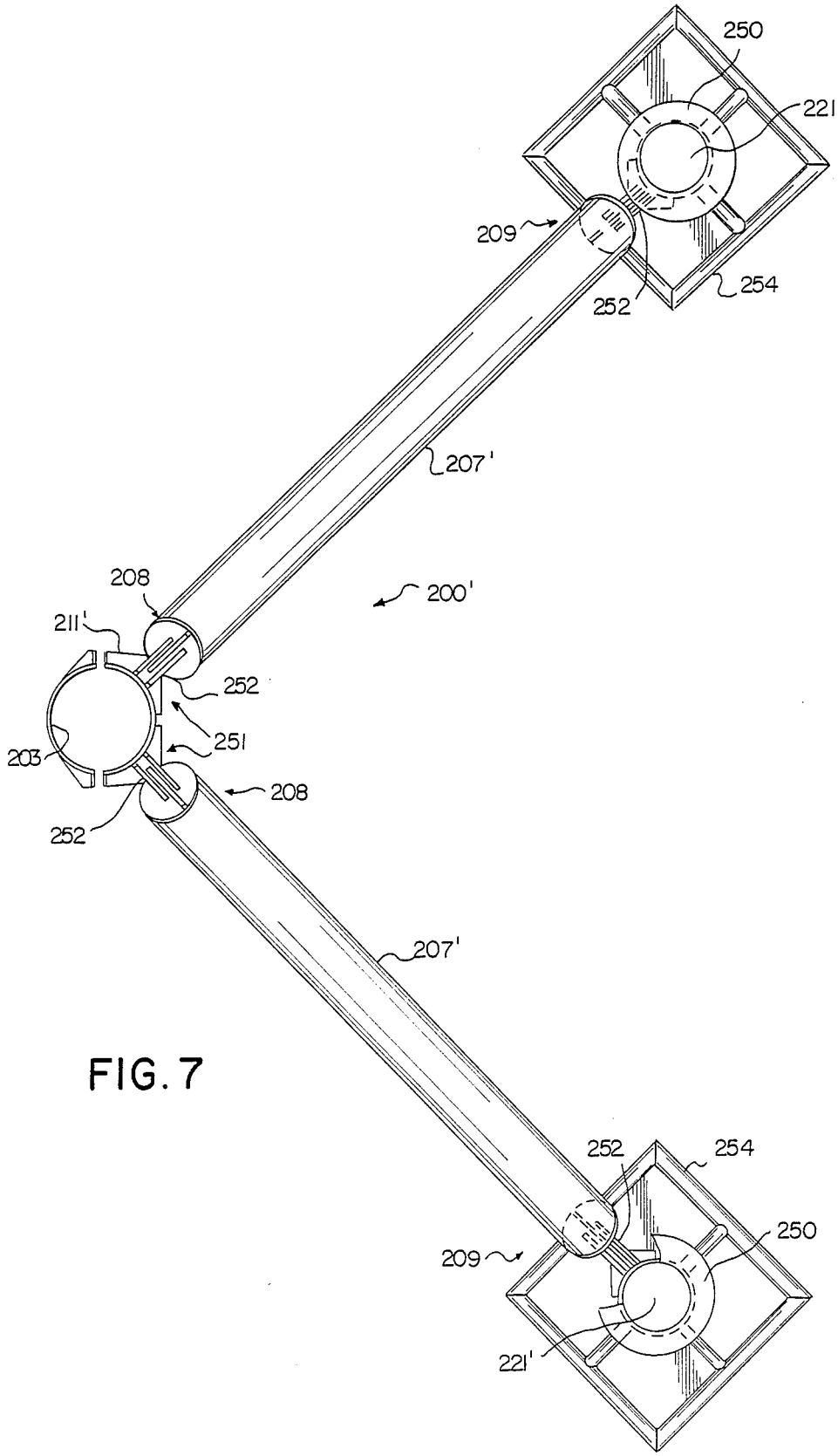
FIG. 7 is a top view of the support structure of FIG. 6.
Figure 8:
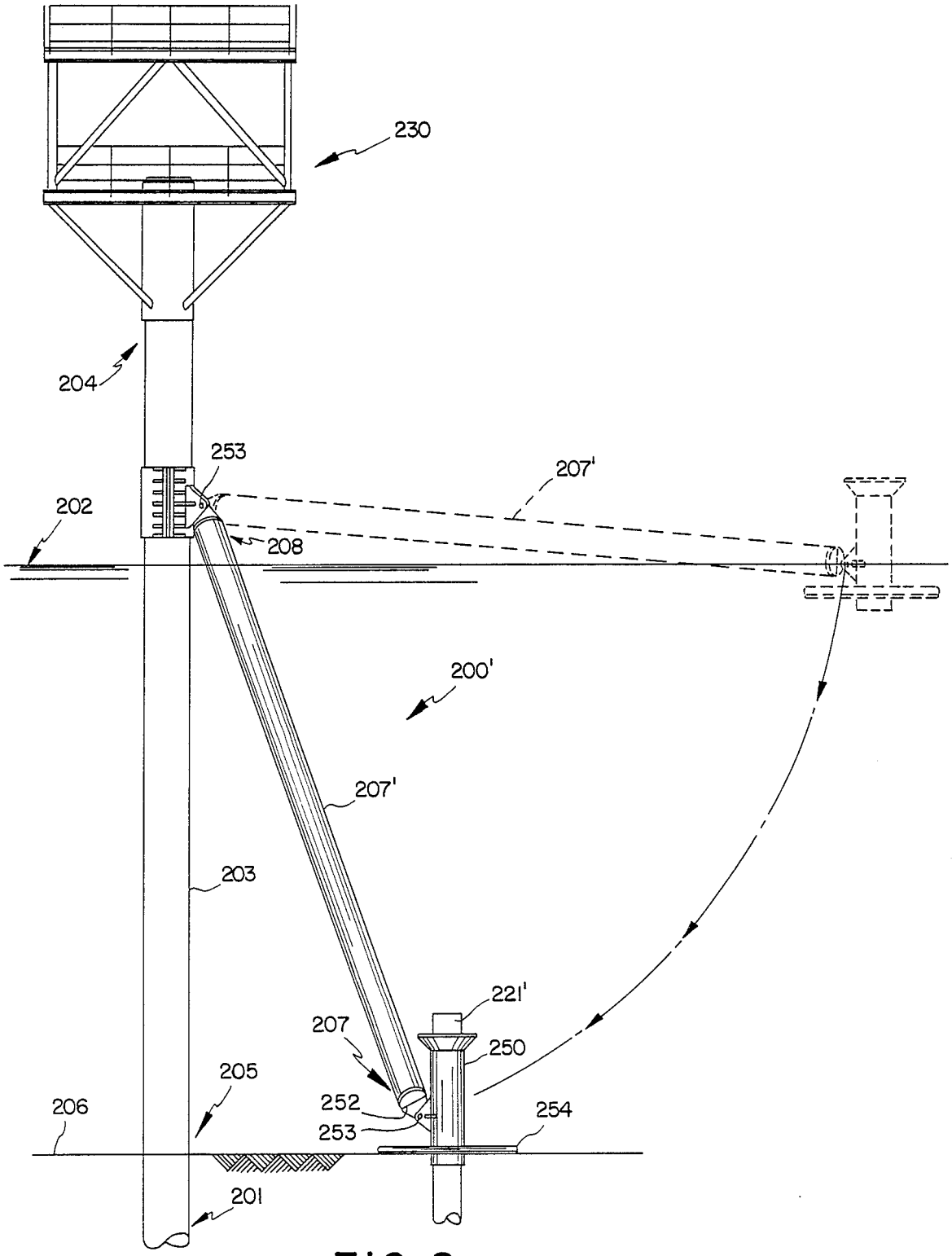
FIG. 8 is a side view of the support structure of FIG. 6, illustrating a platform structure being supported by the conductor pipe.

With reference now to FIGS. 6–8, another embodiment of a support structure 200' for use with a well 201 having an upstanding conductor pipe 203 will be described. The same reference numerals will be utilized for components previously described in connection with FIGS. 1–5. Prime reference numerals will be utilized for components similar to those bearing the same unprimed reference numerals previously described in FIGS. 1–5.

Once again, conductor pipe 203 extends from the ground 206 below the body of water 202 to above the surface of the water 202. Support structure 200' generally includes two tubular legs 207', each leg 207' having upper and lower ends 208, 209; a pile skirt 250 pivotably disposed at the lower end 209 of each of the two legs 207'; and means for pivotably connecting 251 the upper ends 208 of each of the two legs 207' to the conductor pipe 203.

As will be hereinafter described in greater detail, upon legs 207' being pivoted downwardly, as shown in dotted lines in FIG. 8, into engagement with ground 206, each tubular leg 207' extends from the ground 206 to at least the surface of the water 202 as seen in FIG. 6. Alternatively as shown in FIG. 8, each leg 207' can extend from ground 206 to a location disposed above the surface of the water 202. As seen in FIG. 7, each of the two legs 207' are radially spaced from one another. The pivotal connection means 251 is preferably disposed upon the conductor pipe 203 at a location at least at the surface of the water 202, as shown in FIG. 6 or at a higher location upon conductor pipe 203, as seen in FIG. 8. Preferably, pivotal connection means 251 includes a conductor pipe clamp 211' adapted to be fixedly secured to the conductor pipe 203. Conductor pipe clamp 211 differs from the conductor pipe clamps 211, 212, previously described in connection with FIGS. 1–5 only by conductor pipe clamp 211' including two pivot pin joints 252, which joints 252 are radially spaced about the pipe clamp 211', as seen in FIG. 7. Each pivot pin joint 252 is associated with the upper end 208 of a leg 207', whereby legs 207' are freely pivotable with respect to conductor pipe clamp 211', about pivot pins 253 of pivot pin joints 252. Preferably, each pile skirt 250 has a conventional mud mat 254 fixedly secured thereto. Mud mats 254 are provided to pile skirts 250 to prevent them from sinking into potentially soft ground 206 before piles 221' (FIG. 8) can be driven through pile skirts 250. Each pile skirt 250 is pivotably connected to the lower end 209 of legs 207' by the same pivotal connection means 251 previously described. Preferably, such pivotal connection is accomplished via a pivot pin joint 252 previously described.

Still with reference to FIGS. 6–8, the method for supporting an upstanding conductor pipe 203 of a well 201 located in a body of water 202 will be described. The method generally comprises the steps of: floating in the water two legs 207'; disposing the upper ends 208 of each leg 207' adjacent the portion of the conductor pipe 203 extending above the surface of the water 202; pivotably connecting the upper ends 208 of each of the two legs 207' to the conductor pipe 203 at the surface of the water 222 (or at a location upon the conductor pipe 203 higher than the surface of the water 202 (FIG. 8); pivoting each of the legs 207' downwardly until the pile skirt 250 of each leg 207' contacts the ground 206 (FIG. 8); and driving a single pile 221' through each pile skirt 250 to fixedly secure each leg 207' to the ground 206, whereby the conductor pipe 203 is supported toward its upper end 204 within the body of water 202. The method further preferably includes the step of circumferentially disposing a mud mat 254 about each pile skirt 250. The method may further preferably include the steps of pivotably connecting the upper ends 208 of each leg 207' to the conductor pipe 203 by securing a pipe clamp 211' to the conductor pipe 203; and disposing two pivot pin joints 252 radially spaced about the pipe clamp 211', each pivot pin joint 252 having a portion thereof secured to the pipe clamp 211' and the upper end 208 of a leg 207'.

Specifically with reference to FIG. 8, it is seen that the method may further include the step of disposing a platform structure 230 upon the conductor pipe 203, the platform structure 230 being fixedly secured to only the conductor pipe 203. Platform structure 230 is the same as that previously described in connection with FIG. 4. It should be noted that as shown in FIGS. 6 and 8 that pipe clamp 211' can be disposed either at the surface of water 202 or at a location disposed along the conductor pipe 203 higher than the surface of the water. However, in each instance, the bolts (not shown) used to secure pipe clamp 211' to conductor pipe 203 may be readily tightened without the necessity of sending divers to the ground 206 below the body of water 202.

Figure 9:
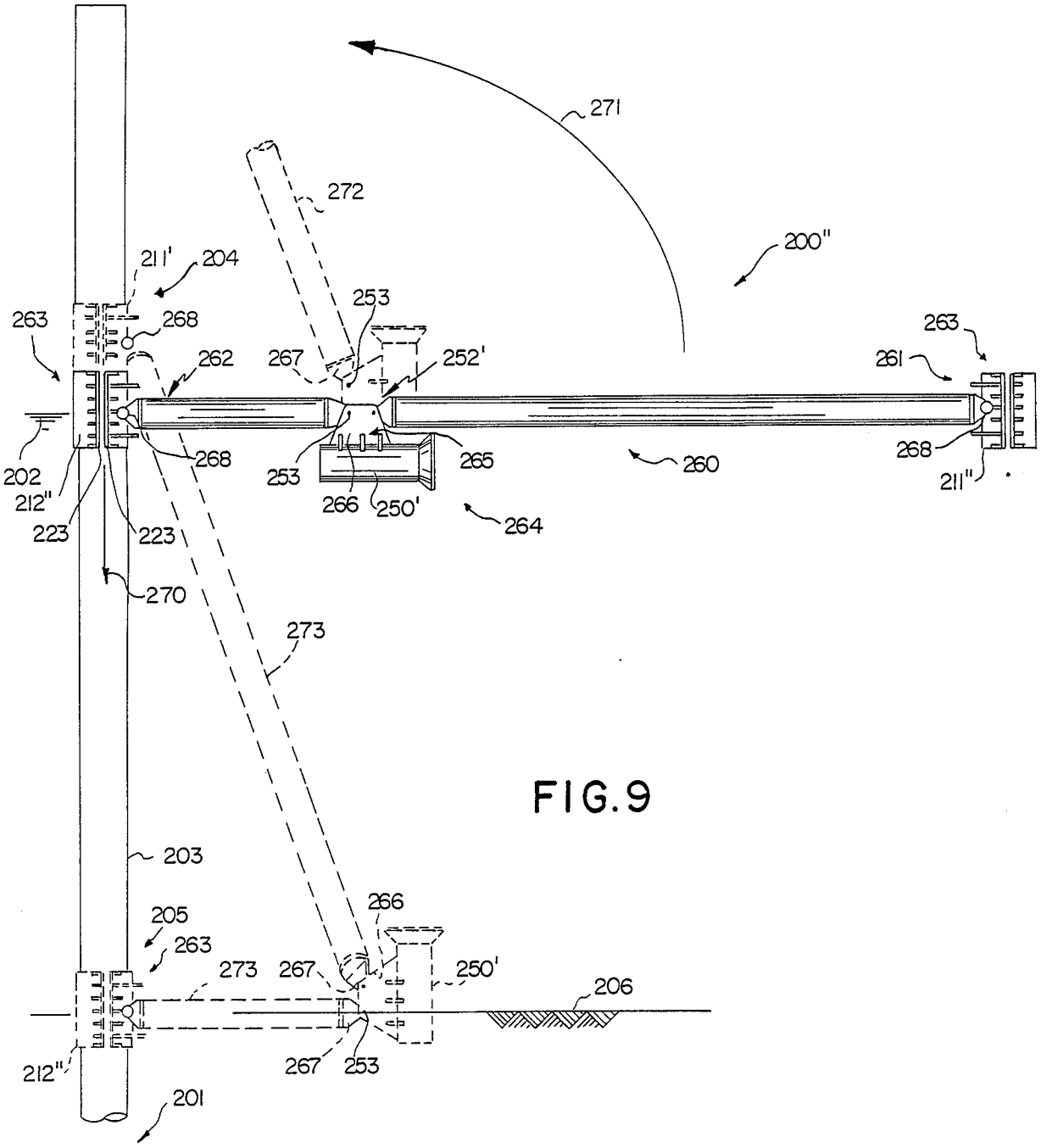
FIG. 9 is a side view of another support structure in accordance with the present invention.
Figure 10:
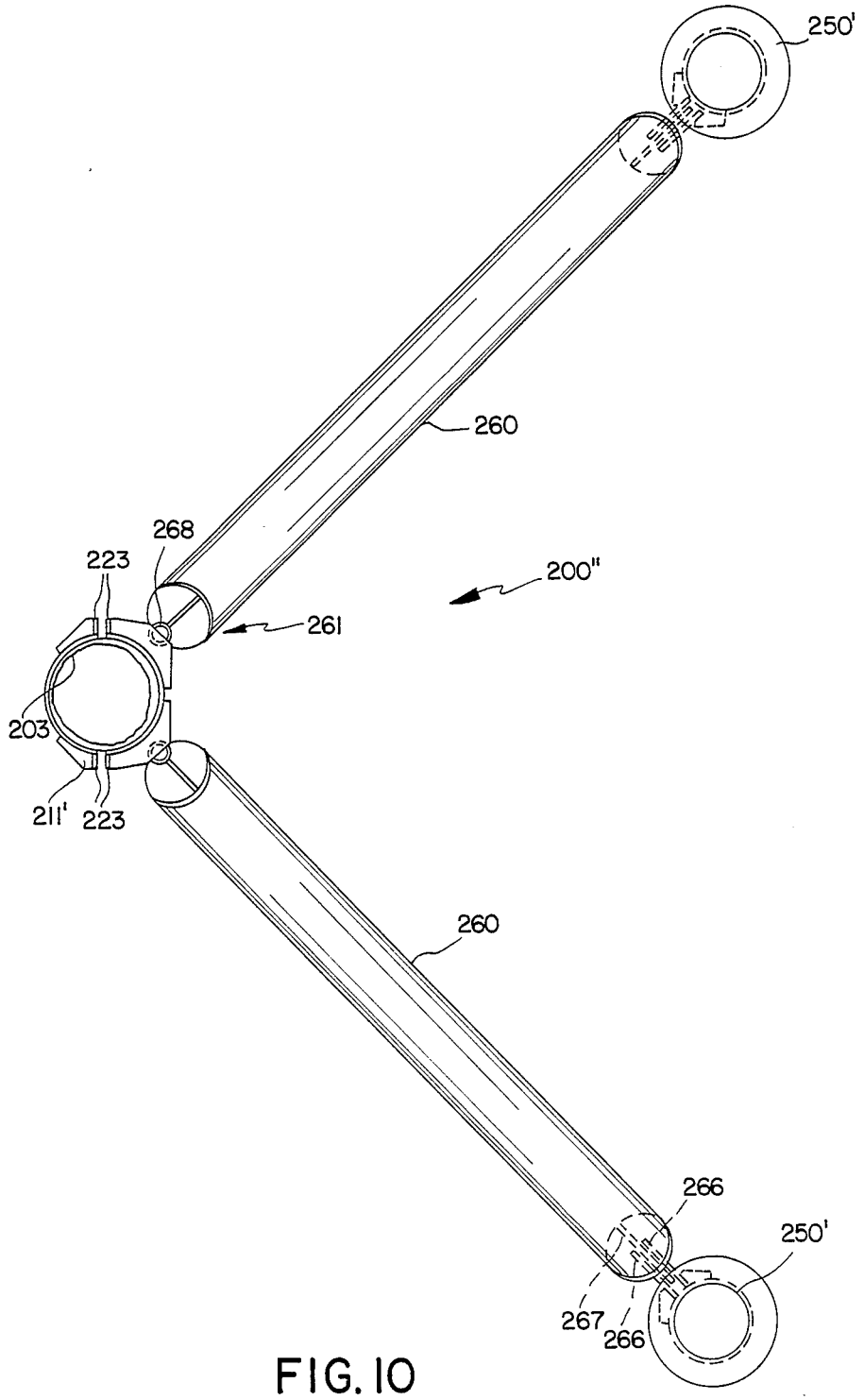
FIG. 10 is a top view of the support structure of FIG. 9.
Figure 11:
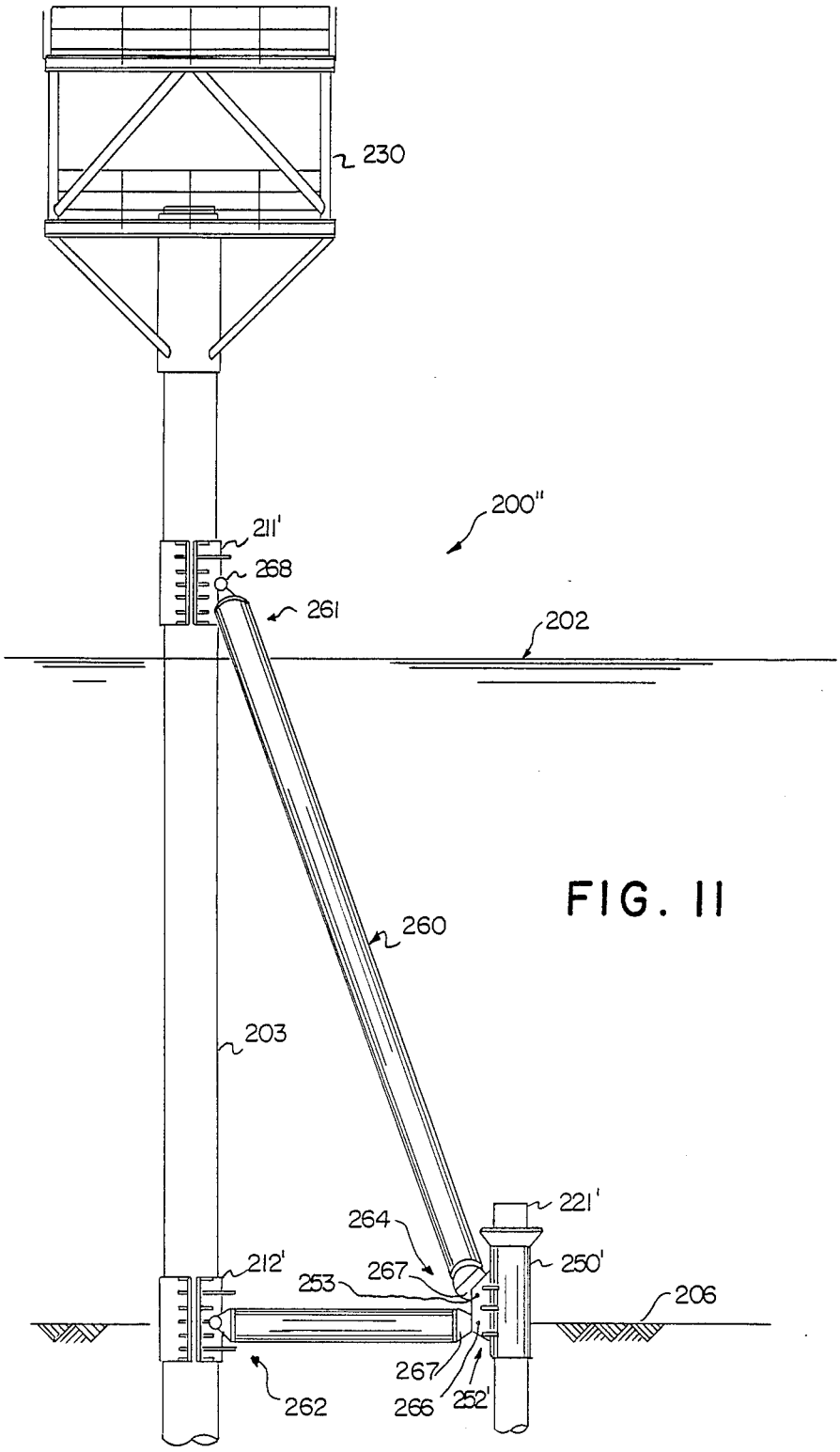
FIG. 11 is a side view of the support structure of FIG. 9 illustrating a platform structure being supported by the conductor pipe.

With reference now to FIGS. 9–11, another embodiment of a support structure 200" for use with a well 201 having an upstanding conductor pipe 203 will be described. The same reference numerals will be utilized for components previously described in connection with FIGS. 1–5 or 6–8. A double prime reference numeral will be utilized for components similar to those bearing the same prime reference numeral previously described in FIGS. 1–8.

Once again, conductor pipe 203 extends from the ground 206 below the body of water 202 to above the surface the surface of the water 202. Support structure 200" generally includes at least one elongate support member 260 having upper and lower ends 261, 262; a means for connecting 263 the support member 260 to the conductor pipe 203; and a means for pivotably connecting 264 the upper end 261 of the support member 260 with respect to the lower end 262 of the support member 260. The connection means 263 is preferably disposed both at the upper and lower ends 261, 262 of support member 260. Pivotal connection means 264 is preferably disposed between the upper and lower ends 261, 262 of the support member 260. As will be hereinafter described in greater detail, the lower end 262 of the support member 260 may be connected to the conductor pipe 205 and the upper end 261 of the support member 260 is pivoted until the upper end 261 of the support member 260 is connected to the conductor pipe 203 toward the upper end 204 of the conductor pipe 203.

Still with reference to FIGS. 9–11, the connection means 263 may preferably comprise pipe clamps 211", 212", and pipe clamps 211", 212" are preferably pivotably connected to the upper and lower ends 261, 262 of the support member 260 by conventional ball joints 268 which permit free pivotal movement of the upper and lower ends 261, 262 of support member 260 with respect to the pipe clamps 211", 212". Alternatively, connection means 263 may utilize pivot pin joints (not shown) which are identical in construction to the pivot pin joints 252 previously described in connection with the support structure 200' of FIGS. 6–8. In this regard, pipe clamps 211", 212" are identical in construction to the pipe clamp 211', when provided with pivot pin joints 252, and only differ in construction from the pipe clamps 211' of FIGS. 6–8, if they are provided with the ball joints 268 of FIGS. 9–11.

The upper and lower ends 261, 262 of support member 260 are pivotably connected with respect to one another at a location intermediate the upper and lower ends 261, 262 of support member 260. Preferably, pivotal connection means 264 includes two pivot pin joints 252', similar in construction to the pivot pin joints 252 previously described in connection with FIGS. 6–8. Each of the two pivot pin joints 252' have a portion thereof associated with an intermediate support member 265, the intermediate support member 265 being disposed between the upper and lower ends 261, 262 of support member 260. Preferably, as seen in FIG. 10, intermediate support member 265 is comprised of two plate members 266 through which pivot pins 253 pass and engage plate members 267 associated with the upper and lower ends 261, 262 of support member 260, as seen in FIGS. 9–11. Of course, upper and lower ends 261, 262 of support member 260 could be pivotable with respect to one another about a common pivot pin 253, without utilizing intermediate support member 265.

Still with reference to FIGS. 9–11, a pile skirt 250'' may be associated with the intermediate support member 265, in any suitable manner. Preferably, pile skirt 250' is fixedly secured to the intermediate support member 265, and as will be hereinafter described in greater detail is moveable therewith. Pile skirt 250' may be fixedly secured to the plate members 266 of intermediate support member 265 in any conventional manner, such as by welding.

Support member 260 may have any cross-sectional configuration, such as square, triangular, rectangular, etc.; however, it is preferred that support member 260 be of tubular construction, as is conventional for offshore construction. Support member 260 is further self-floatable in a body of water 202, as will be hereinafter described in greater detail. As seen in FIG. 11, a platform structure 230 such as a small production deck, may be disposed upon conductor pipe 203, platform structure 230 being similar to that previously described in connection with FIGS. 4 and 8. It should be noted that in some applications, support structure 200'' may include only one support member 260; however, in most applications, it is preferable that there be two support members 260 for support structure 200'', as illustrated in FIG. 10 For example, for relatively short conductor pipes 203, and/or in bodies of water 202 wherein the forces exerted upon conductor pipe 203 are not expected to be very great, one support member 260 of support structure 200'' could very will suffice.

Still with reference to FIGS. 9–11, the method in accordance with the present invention for supporting an upstanding conductor pipe 203 located in a body of water 202 will be described. The method generally comprises the steps of: disposing at least one elongate support member 260 adjacent the upper end 204 of a conductor pipe 203 at the surface of water 202; connecting the lower end 262 of the at least one support member 260 to the conductor pipe 203; lowering the lower end 262 of the at least one support member 260 and pivoting the upper end 261 of the support member 260 with respect to the lower end 262 of the support member 260; connecting the upper end 261 of the at least one support member 260 to the conductor pipe 203; and fixedly securing the upper and lower ends 261, 262 of the at least one support member 260 to the conductor pipe 203, whereby the at least one support member 260 supports the conductor pipe 203 against forces exerted upon it by the body of water 202.

The at least one elongate support member 260 of support structure 200'' can be disposed adjacent to the upper end 204 of conductor pipe 203 in a variety of ways. Pipe clamp 212'' may be completely closed, with the bolts (not shown) of pipe clamp flanges 223 being loosely bolted to one another, and pipe clamp 212'' may be stabbed over the upper end 204 of conductor pipe 203. Support structure 200'' would be lifted by a suitable crane (not shown) disposed upon a suitable vessel, such as a barge (not shown), which vessel could have support structure 200'' disposed thereon. Alternatively, support structure 200'' could be floated in the body of water 202 until it is disposed adjacent conductor pipe 203. If pipe clamp 212'' is not stabbed over conductor pipe 203, as previously described, the at least one support member 260 would be floated, or lifted, until it is adjacent conductor pipe 203, at which time the conductor pipe clamp 212'' disposed at the lower 262 of support member 260 would be loosely clamped about conductor pipe 203.

After the pipe clamp 212'' associated with the lower end 262 of support member 260 is connected to the conductor pipe 203, the lower end 262 of support member 260 is lowered, such as by lowering pipe clamp 211'' and the lower end 262 by a crane or by flooding the interior of the lower end 262 of support member 260, to cause it to sink toward the ground 206. The lower end 262 of the support member 260 is lowered in the direction shown by arrow 270 of FIG. 9. The upper end 261 of support member 260 may be pivoted with respect to the lower end of 262 of support member 260, the pivoting being in an upward direction toward conductor pipe 203, in the direction of arrow 271 of FIG. 9. The upper end 261 pivots with respect to lower end 262 about the pivotal connection means 264 as previously described. As seen in FIG. 9, the upper end 261 may be pivoted in the direction of arrow 271 either while pipe clamp 212'' associated with the lower end 262 is being lowered; or the upper end 261 can be pivoted in the direction of arrow 271 until it assumes the position shown in dotted lines 272, at which time upper and lower ends 261, 262 of support member 260 would both be lowered until they assume the position shown in dotted lines 273 of FIG. 9. If the upper end 261 is pivoted to the position shown by dotted lines 272, the pipe clamp 211'' associated with the upper end 261 may either be stabbed over the the upper end 204 of conductor pipe 203, or pipe clamp 211'' could be initially in an open position, and then subsequently loosely clamped about the upper end 204 of conductor pipe 203. As previously described, the two pipe clamps 211'' are each pivotably connected to one of the legs 261, 262 of support member 260. Intermediate support member 265 may be disposed between the upper and lower ends 261, 262 of support member 260 and a pile skirt 250' may be associated with the intermediate support member 265.

After the support structure 200'' has been lowered into the position shown in dotted lines 273 in FIG. 9 or as shown in FIG. 11, the bolts (not shown) of pipe clamps 211'', 212'' are fixedly secured, and a pile 221' may then be driven through pile skirt 250' into the ground 206 in conventional manner. After support structure 200'' is completely secured, as previously described, a platform structure 230 may be disposed upon the conductor pipe 203, as previously described.

With reference to the embodiment of the present invention as shown in FIGS. 9–11, it should be noted that, if desired, a mud mat 254 could be associated with the pile skirt 250', as previously described in connection with FIGS. 6–8. Although the various support structures 200, 200', 200'' of the present invention have all been previously described in use in connection with an upstanding conductor pipe 203, it should of course be apparent to those skilled in the art that other vertical members disposed in a body of water could also be supported by the support structures 200, 200', 200'' of the present invention. Such vertical members could be, for example, riser pipe, flare lines. Accordingly the use of the term "conductor pipe" should encompass such other vertical members, when appropriate.

Figure 13:
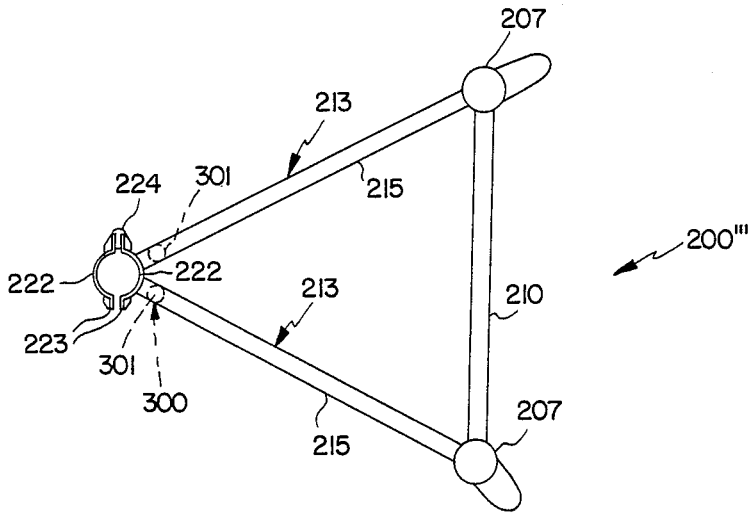
FIG. 13 is a top view of the support structure of FIG. 12.
Figure 12:
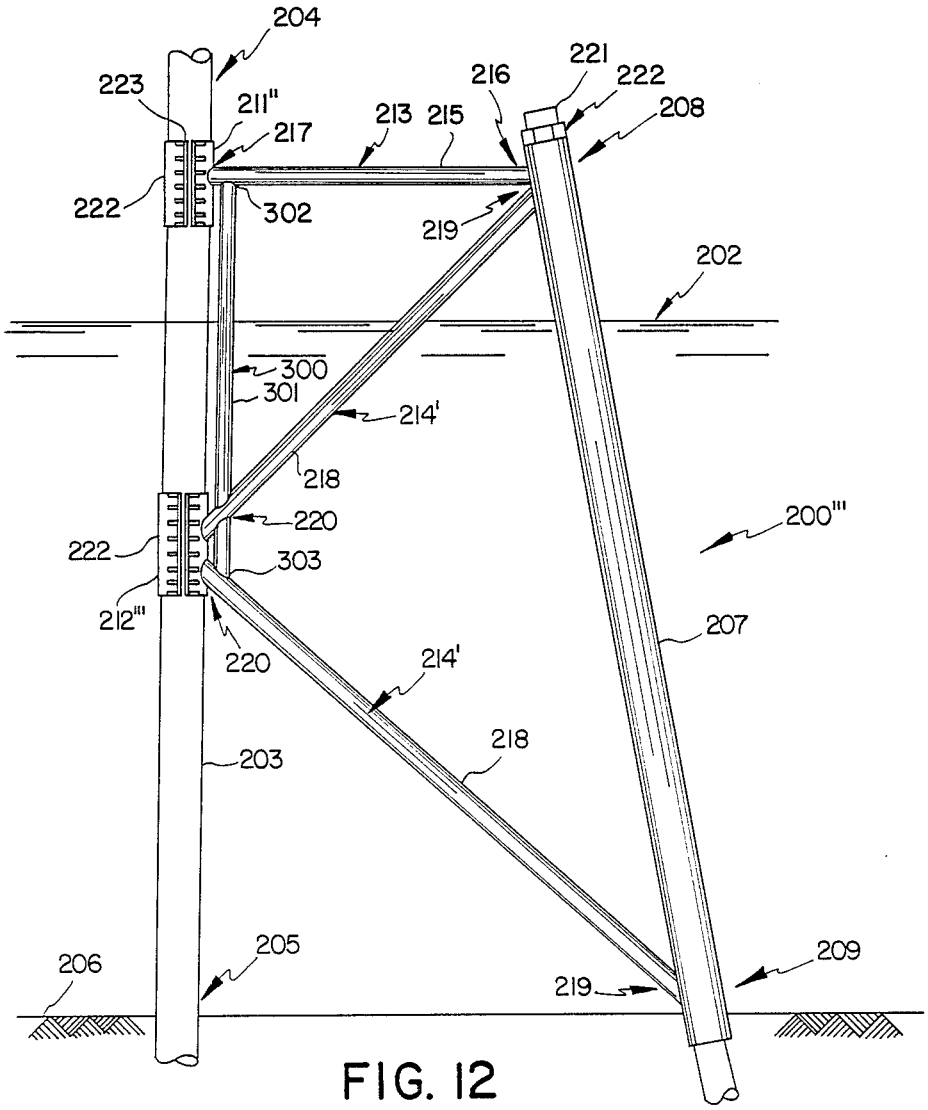
FIG. 12 is a side view of a support structure in accordance with the present invention.

With reference to FIGS. 12–13, another embodiment of a support structure 200''' in accordance with the present invention or use with a well 201 located in a body of water 202 will be described. The same reference numerals will be utilized for components previously described in connection with FIG. 1–5. Primed reference numerals will be utilized for components similar to those bearing the same unprimed reference numerals previously described in FIGS. 1–5.

Once again, the well 201 has an upstanding conductor pipe 203, having upper and lower ends 204, 205, extending from the ground 206 below the body of water 202 to above the surface of the water 202. Support structure 200''' generally comprises two tubular legs 207, each leg having upper and lower ends 208, 209; a first set of bracing members 210 disposed between and interconnecting legs 207 in a spaced relationship from one another; first and second conductor pipe clamps 211, 212'; a second set of bracing members 213; a third set of bracing members 214'; and a fourth set of bracing members 300.

Still with reference to FIGS. 12–13, it is seen that each of the tubular legs 20 has their upper ends 208 extending beyond the surface of the water 202, and the lower end 209 of each leg 207 is disposed upon ground 206. As seen in FIGS. 12 and 13, the first conductor pipe clamp 211 is disposed about the upper end 204 of conductor pipe 203, and the second conductor pipe clamp 212' is disposed about the conductor pipe 203, intermediate the upper and lower ends 204, 205 of conductor pipe 203. As seen in FIGS. 12–13, each bracing member 215 of the second set 213 of bracing members has first and second ends 216, 217. The first ends 216 of each bracing member 215 are connected to one of the legs 207. The second ends 217 of each bracing member 215 are secured to the first conductor pipe clamp 211, and each of the bracing members 215 of the second set 213 of bracing members extend outwardly and away from each of the legs 207.

Still with reference to FIGS. 12–13, it is seen that each bracing member 218 of the third set 214' of bracing members has first and second ends 219, 220, the first ends 219 of each bracing member 218 are connected to one of the legs 207. The second ends 220 of each bracing member 218 are secured to the second conductor pipe clamp 212', and the third set 214' of bracing members 218 are seen to each extend outwardly and away from each of the legs 207. As will be hereinafter described in greater detail, a conventional pile 221 is disposed within each leg 207, piles 221 having been driven into the ground 206 in a conventional manner. A segmented sleeve, coupling or pile to jacket connection 222 may be utilized to secure the pile 221 to leg 207.

A bracing member 218 of the third set 214' of bracing members is disposed between second conductor pipe clamp 212' and each leg 207, some of the bracing members 218 extending from a location disposed proximate the lower end 209 of each leg 207. Likewise, extending between the second conductor pipe clamp 212' and the upper ends 208 of each leg 207, there is disposed a bracing member 218 of the third set 214' of bracing members. In turn, a bracing member 301 of the fourth set 300 of bracing members, having first and second ends 302, 303, is associated with and disposed between the first and second conductor pipe clamps 211, 212', each bracing member 301 of the fourth set 300 being disposed substantially parallel with the conductor pipe 203, as shown in FIGS. 12 and 13. Preferably, each bracing member 301 of the fourth set 300 has its first end 302 connected to at least one of the bracing members 215 of the second set 213 and its second end 303 is connected to at least one of the bracing members 218 of the third set 214' of bracing members. Preferably, the second end 303 of bracing member 301 is connected to both ends 220 of bracing members 218 of the third set 214', whereby the second end 303 of bracing member 301 is welded, or in some other suitable manner is connected, to at least two ends 220 of bracing members 218. Thus, a rigid support structure 200''' is provided which has adequate rigidity, or stiffness, to carry lateral loads or forces exerted by the body of water 202 upon support structure 200 and conductor pipe 203.

It should be noted that the components of support structure 200''', specifically, legs 207, and the first, second, third, and fourth sets of bracing members 210, 213, 214, and 300 are constructed of conventional materials utilized for offshore utilization, and are preferably of tubular steel construction. First and second conductor pipe clamps 211, 212' are preferably each formed of two steel plates 222 having a semi-circular cross-sectional configuration. Each plate 222 also have a pair of outwardly extending flanges 223 through which a plurality of bolts (not shown) may be passed through to securely clamp the first and second conductor pipe clamps 211, 212' to conductor pipe 203. Such clamping in turn securely clamps the support legs 207 to conductor pipe 203 via the second, third, and fourth sets of bracing members 213, 214', 300. Alternatively, plate members 222 could be hinged to one another as at 224 (FIG. 13), whereby each plate member 222 would only have one outwardly extending flange 223, and only one set of bolts (not shown) would need to be passed through the flange members 223 to secure the conductor pipe clamps 211, 212' to conductor pipe 203.

The installation of support structure 200''' of FIGS. 12–13 is readily accomplished in the following manner. The support structure 200'' is typically taken by a barge to the location of well 201 and conductor pipe 203, whereat support structure 200'' is lifted by a crane until the first and second conductor pipe clamps 211, 212' abut conductor pipe 203. The crane (not shown) is typically disposed upon the barge (not shown) or another vessel. The crane could suspend the support structure 200''' adjacent conductor pipe 203 so that both conductor pipe clamps 211, 212' may be loosely secured by tightening the bolts (not shown) through flange members 223. Alternatively, the second conductor pipe clamp 212' could be secured first while being disposed above the surface of water 202, and then support structure 200''' could be lowered until the first conductor pipe clamp 211 can be loosely tightened upon conductor pipe 203. Further dependent upon the height of pipe 203 which extends above the surface of water 202, either clamp 211 or both clamps 211, 212 could be loosely bolted together, and the clamp or clamps of support structure 200''' could be stabbed over the upper end 204 of pipe 203. In any case, after the conductor pipe clamps 211, 212' are loosely secured to conductor pipe 203, support structure 200''' is lowered until the lower ends 209 of the tubular legs 207 rest upon the ground 206 and the second conductor pipe clamp 212 is disposed at a location intermediate ground 206 and water level 202.

With certain soil conditions support structure 200'' is lowered until it assumes the position shown in FIG. 12, wherein the lower ends 209 of legs 207 have sunk slightly into ground 206. Divers are then sent into water 202 in order to tighten the bolts of the second conductor pipe clamp 212'. From the surface of water 202, the bolts of the first conductor pipe clamp 211 may be readily fixedly secured. A pile 221 is then driven through each of the legs 207 in a conventional manner to firmly secure support structure 200''' to the ground 206. As previously described, a segmented sleeve, coupling, or pile to jacket connection device 222 is then installed to securely affix pile 221 to the leg 207. If a permanent installation of support structure 200''' is desired, and/or for further strength, the first conductor pipe clamp 211, as well as the second conductor pipe clamp 212', if desired, could be welded to the conductor pipe 203 in a conventional manner.

Figure 14:
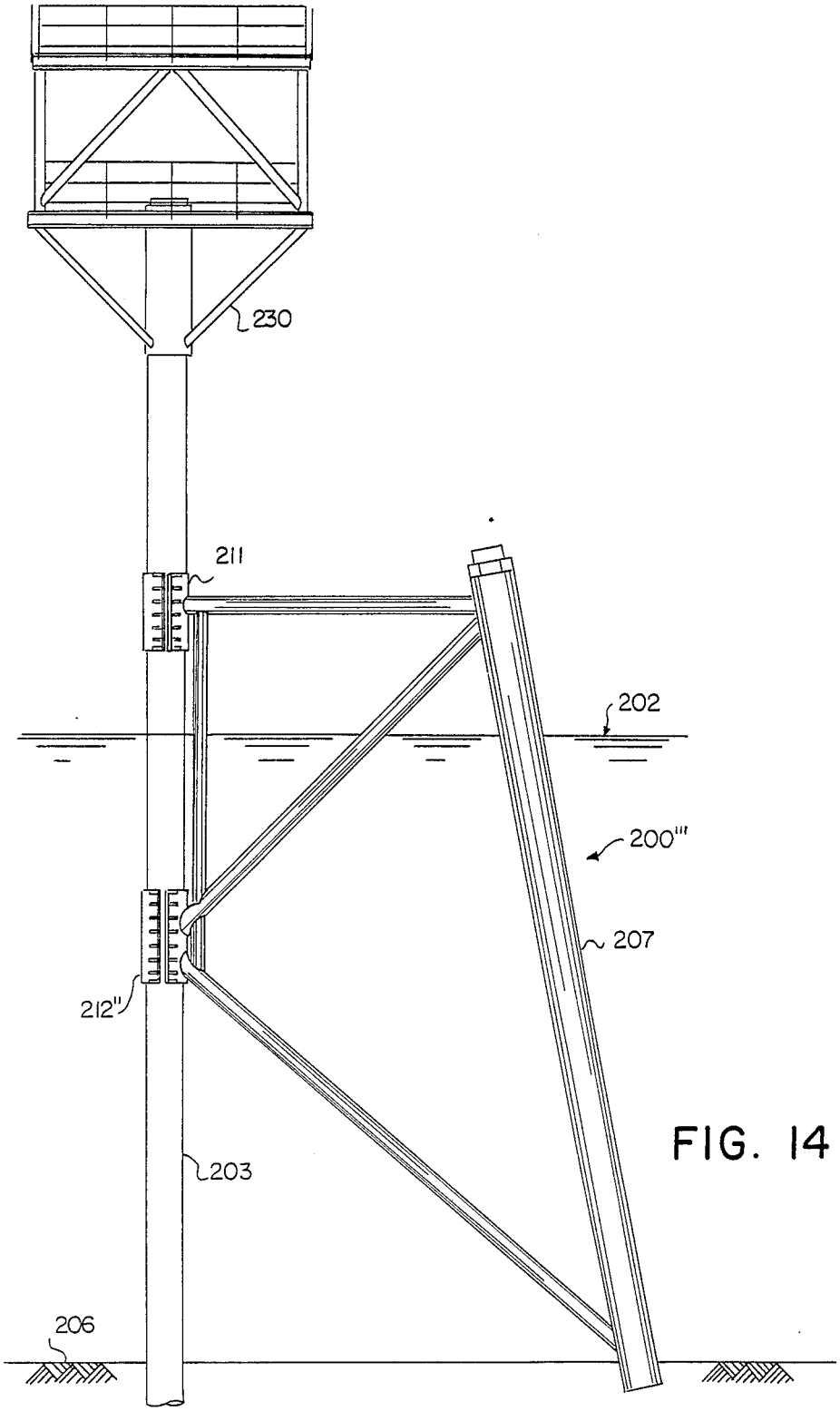
FIG. 14 is a side view of the support structure of FIG. 12, illustrating a platform structure being supported by the conductor pipe.
Figure 15:
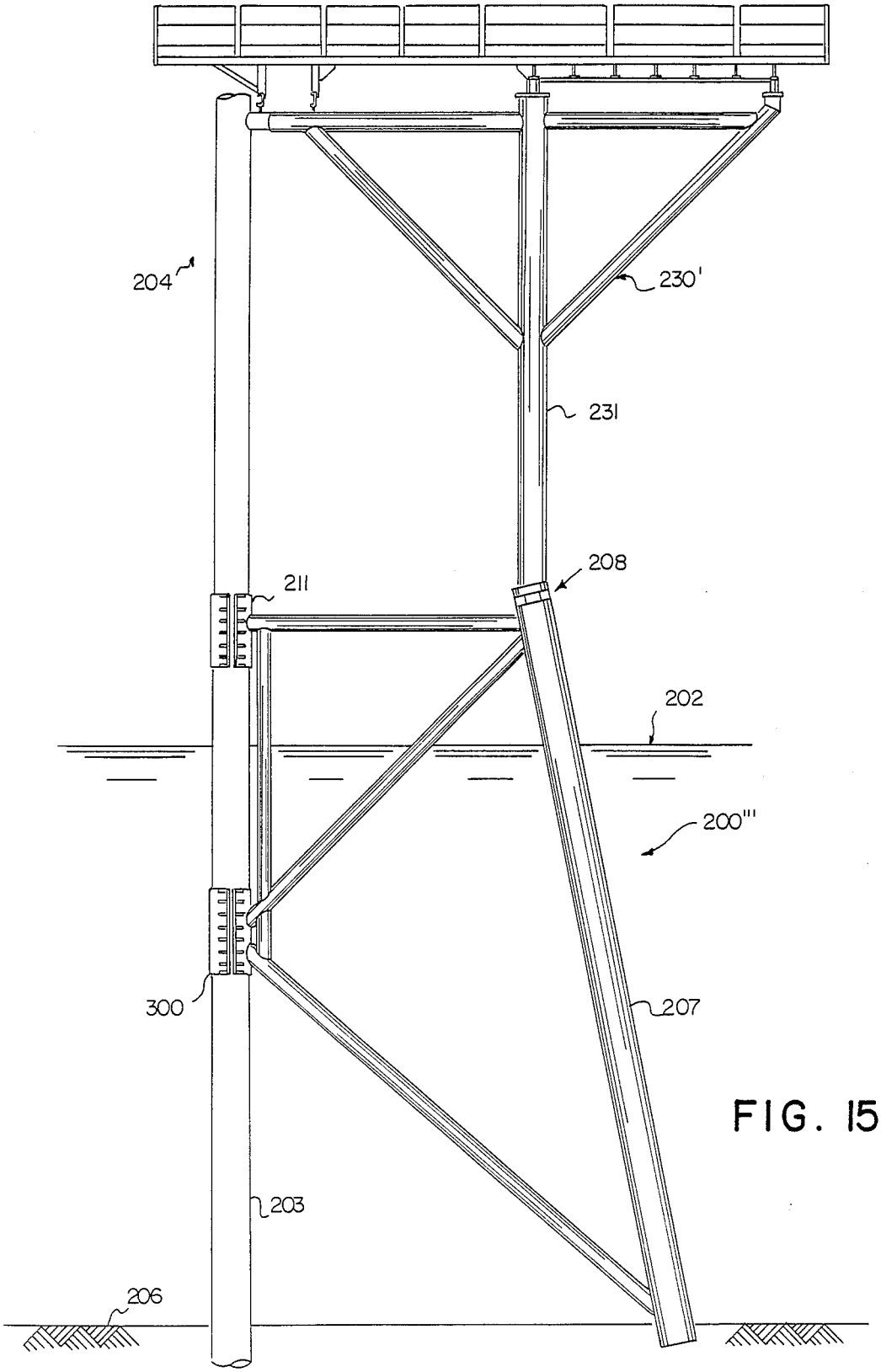
FIG. 15 is a side view of the support structure of FIG. 12, illustrating a platform structure being supported by the conductor pipe and the support structure of FIG. 12.

With reference to FIGS. 14 and 15, it is seen that support structure 200''' could be utilized to support conductor pipe 203 whereby a platform structure 230 may be disposed upon and supported solely by conductor pipe 203, as seen in FIG. 14. Alternatively, as seen in FIG. 15, a platform structure 230' could be disposed upon and supported by conductor pipe 203 and the two legs 207 of support structure 200'''. The platform structure 230 of FIG. 14 could be either a small production or caisson deck which provides means for access to the wellhead, or conductor pipe 203, as seen in FIG. 14.

The platform structure 230' of FIG. 15 is illustrated to be a full production deck as is conventional in the art. A portion of the production deck, or platform structure 230', rests upon the upper end 204 of conductor pipe 203, and two vertical support columns 231 are disposed upon the upper ends 208 of each of the legs 207.

It is to be understood that the invention is not limited to the exact details of construction, operation, exact materials or embodiments shown and described, as obvious modifications and equivalents will be apparent to one skilled in the art; for example, the various pivotal connection means could be universal joints. Accordingly, the invention is therefore to be limited only by the scope of the appended claims.

I claim:

1. A support structure for use with a well located in a body of water, the well having an upstanding conductor pipe, having upper and lower ends, extending from the ground below the body of water to above the surface of the water, comprising:

two tubular legs, each leg having upper and lower ends, the upper end of each leg adapted to extend beyond the surface of the water and the lower end of each leg adapted to be disposed upon the ground;

a firt set of bracing members disposed between and interconneting the legs in a spaced relationship from one another;

first and second conductor pipe clamps, the first conductor pipe clamp adapted to be disposed about the upper end of the conductor pipe, and the second conductor pipe clamp adapted to be disposed about the conductor pipe intermediate the upper and lower ends of the conductor pipe;

a second set of bracing members, each bracing member of the set having first and second ends, the first ends of each bracing member being connected to one of the legs, the second ends of each bracing member being secured to the first conductor pipe clamp, the second set of bracing members extending outwardly and away from each of the legs; and a third set of bracing members, each bracing member of the set having first and second ends, the first ends of each bracing member being connected to one of the legs, the second ends of each bracing member being secured to the second conductor pipe clamp, the third set of bracing members extending outwardly and away from each of the legs, whereby upon the first and second conductor pipe clamps being secured to the upper and lower ends of the conductor pipe, the conductor pipe will be supported by the legs and the second and third sets of bracing members.

2. The support structure of claim 1, wherein a pile is disposed within each leg, the piles being adapted to be driven into the ground.

3. The support structure of claim 1, wherein from each leg, from a location disposed of the upper end of each leg, a bracing member of the third set of bracing members extends to the second conductor pipe clamp.

4. The support structure of claim 1, wherein from each leg, from a location disposed at the lower end of each leg, a bracing member of the third set of bracing members extend to the second conductor pipe clamp.

5. The support structure of claim 2, wherein a platform structure is disposed upon and supported by the conductor pipe.

6. The support structure of claim 2, wherein a platform structure is disposed upon and supported by the conductor pipe and the two legs.

7. The support structure of claim 1, including a fourth set of bracing members, each bracing member of the set having first and second ends, the first ends of each bracing member being connected to at least one of the bracing members of the second set of bracing members and the second ends of each bracing member being connected to at least one of the bracing members of the third set of bracing members.

8. The support structure of claim 7, wherein the first ends of each bracing member of the fourth set are connected to the second end of the bracing members; and the second ends of each bracing member of the fourth set are connected to the second end of the third set of bracing members.

9. The support structure of claim 1, including a fourth set of bracing members, each bracing member of the fourth set being associated with, and disposed between the first and second conductor pipe clamps, each bracing member of the fourth set being disposed substantially parallel with the conductor pipe.

* * * * *

UNITED STATES PATENT AND TRADEMARK OFFICE

CERTIFICATE OF CORRECTION

PATENT NO. : 4,842,446

DATED : June 27, 1989

INVENTOR(S) : Samuel C. Carruba

It is certified that error appears in the above-identified patent and that said Letters Patent is hereby corrected as shown below:

Col. 15, line 53, "firt" should read -- first --.

Signed and Sealed this

Fifteenth Day of May, 1990

*Attest:*

HARRY F. MANBECK, JR.

*Attesting Officer*

*Commissioner of Patents and Trademarks*